US005433491A

United States Patent [19]

Green

[11] Patent Number: 5,433,491

[45] Date of Patent: Jul. 18, 1995

[54] BALL PICKUP APPARATUS

[76] Inventor: Peter F. Green, P.O. Box 56277, New Orleans, La. 70156

[21] Appl. No.: 206,887

[22] Filed: Mar. 7, 1994

Related U.S. Application Data

[63] Continuation of Ser. No. 783,986, Oct. 29, 1991, Pat. No. 5,292,161, which is a continuation-in-part of Ser. No. 323,349, Mar. 14, 1989, abandoned.

[51] Int. Cl.[6] ..... A63B 47/02; B65D 85/00

[52] U.S. Cl. ..... 294/19.2; 224/202; 403/307; 206/315.9

[58] Field of Search ..... 294/19.2, 160, 161; 56/332; 206/315.9, 430; 221/307, 310; 224/202, 251, 257; 273/29 R, 32 D, 32 F, 162 E; 403/300, 307, 343, 349

[56] References Cited

U.S. PATENT DOCUMENTS

| | | | |
|---|---|---|---|
| D. 205,526 | 8/1966 | Lehman | 294/19.2 X |
| 1,801,281 | 4/1931 | McEldowney | 403/307 X |
| 2,760,807 | 8/1956 | Watson | 273/162 E X |
| 2,962,321 | 11/1961 | Fowler et al. | 294/19.2 |
| 3,149,872 | 9/1964 | Ward | 294/19.2 |
| 3,180,537 | 4/1965 | Collins | 220/737 X |
| 3,186,593 | 6/1965 | Miotke | 273/32 D X |
| 3,412,897 | 11/1968 | Slater . | |
| 3,485,416 | 12/1969 | Fohrman | 222/142.1 |
| 3,558,170 | 1/1971 | Stanworth | 294/19.2 |
| 3,814,288 | 6/1974 | Westrich | 224/202 X |
| 3,901,545 | 8/1975 | Shott . | |
| 3,957,297 | 5/1976 | Hanks | 294/19.2 |
| 4,045,068 | 8/1977 | Nelson . | |
| 4,058,336 | 11/1977 | Parkinson . | |
| 4,063,769 | 12/1977 | Zimmer . | |
| 4,088,251 | 5/1978 | Rodriguez . | |
| 4,398,716 | 8/1983 | Argibay, Jr. et al. | 294/19.2 X |
| 4,441,837 | 4/1984 | Mastroni | 403/300 |
| 4,522,438 | 6/1985 | Logue | 294/19.2 |
| 4,582,447 | 4/1986 | Itoh | 403/300 X |
| 4,629,235 | 12/1986 | Logue | 294/19.2 |
| 4,911,347 | 3/1990 | Wilhite | 224/251 X |

*Primary Examiner*—Dean J. Kramer
*Attorney, Agent, or Firm*—Pravel, Hewitt, Kimball & Krieger

[57] ABSTRACT

A tennis ball retrieval system comprises a removable cap which is preferably sized to fit a standard tennis ball container. The cap has an opening and an inwardly projecting flange for effectively reducing the opening to less than the diameter of a standard tennis ball. The apparatus preferably also includes tennis ball containers having a standard diameter but being capable of containing more than three tennis balls, or having grooves to allow the container to be connected to a like container with a connecting member, or both. Additionally, a strap can be included which allows the container to be carried on one's shoulder.

19 Claims, 5 Drawing Sheets

BALL PICKUP APPARATUS

This is a continuation of Ser. No. 07/783,986, filed Oct. 29, 1991, now U.S. Pat. No. 5,292,161 which is a continuation-in-part of U.S. Patent application Ser. No. 07/323,349, filed Mar. 14, 1989 now abandoned, and hereby incorporated by reference.

BACKGROUND OF THE INVENTION

1. Field of the Invention

The present invention relates to ball pickup devices.

2. General Background of the Invention

Tennis balls are usually sold in cylindrical cans containing three balls. These cans were at one time made of metal, but more recently are made of clear plastic. The cans have a first, open end and a second, closed end, and are pressurized and sealed with a metal pop-top. A removal flexible plastic cap is removably fitted on the first end, over the metal pop-top, to hold the balls in the container when the metal pop-top is removed.

Various devices to pick up balls have been proposed. See, for example, U.S. Pat. Nos. 4,045,068; 4,063,769; 4,088,251; 4,522,438; and 4,629,235 (tennis ball retrievers); and U.S. Pat. Nos. 3,412,897; 3,901,545; and 4,058,336 (golf ball retrievers). Most of these devices are quite complex and expensive to manufacture, and are not capable of being easily pressurized.

Prior to the present invention, there was no ball pickup device simple and inexpensive enough to also function as a packaging container for tennis balls.

SUMMARY OF THE INVENTION

The present invention comprises a removable retrieving cap which can convert a standard ball packaging container into a ball pickup device. The cap is preferably unitary and has means for allowing a ball to enter the container through the cap and for preventing balls from exiting the container through the cap when the cap is removably fitted on a first, open end of the container.

The present invention also comprises a simple, inexpensive ball packaging and retrieving system which includes containers which can be removably connected to one another, either directly or with the aid of a connecting member, a removable cap as described above, and a strap.

BRIEF DESCRIPTION OF THE DRAWINGS

For a further understanding of the nature, objects, and advantages of the present invention, reference should be had to the following detailed description, taken in conjunction with the accompanying drawings, in which like reference numerals denote like elements, and wherein:

FIGS. 20*a*–33*b*, 35*a*, and 35*b* show alternative embodiments of the cap of the present invention.

FIGS. 34*a* and 34*b* show a clip in accordance with the present invention.

DETAILED DESCRIPTION OF THE PREFERRED EMBODIMENTS

Figure 1:
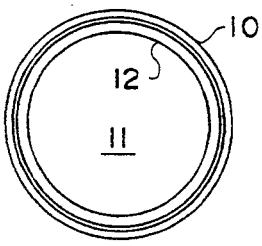
FIG. 1 is a plan view of the preferred embodiment of the removable retrieval cap in accordance with the present invention.
Figure 2:
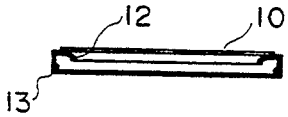
FIG. 2 is a section thereof.

FIGS. 1 and 2 show the preferred embodiment of the removable cap of the present invention, cap 10. Cap 10 is very similar to a standard cap (not shown) of a standard tennis ball package. Cap 10 differs primarily in that there is an opening 11 in the center thereof. Cap 10 can be made by cutting opening 11 out of a standard tennis ball container cap, or forming opening 11 when cap 10 is molded. Opening 11 has a diameter slightly less than the diameter of a tennis ball 1 (see, for example, FIGS. 12 and 13) and is bounded by a flexible inner rim 12. A flexible outer rim 13 allows cap 10 to be removably fitted on a standard tennis ball container 2 (shown in FIGS. 12 and 13) or any of the containers of the present invention. Cap 10 is preferably made of a flexible material, which may be the same as, or similar to, the plastic used to make standard tennis ball container caps.

Figure 3:
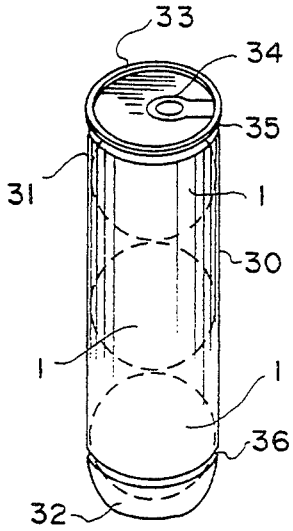
FIG. 3 is a perspective view of a container in accordance with the preferred embodiment of the present invention.

The container of the preferred embodiment of the present invention, container 30, is shown in FIG. 3. Container 30 has a length greater than the diameter of three standard tennis balls and a diameter (as used herein in reference to tennis ball containers, "diameter" shall mean outside diameter, although the difference between inside diameter and outside diameter of the tennis ball containers is generally only a few millimeters) approximately 20% greater than the diameter of a standard tennis ball (the diameter of a standard tennis ball is approximately 2 e,fra 1/2 e inches; the diameter of container 30 is preferably approximately 3 inches). Container 30 is, as are all containers of the present invention, preferably made of a clear plastic so that one can readily tell how many tennis balls are in the container. A suitable plastic is that presently used for standard tennis ball containers. Container 30 has a first, open end 31 and a second, closed end 32. First end 31 has a rigid metal rim 33 to which may be removably connected a standard pop-top 34 to allow container 30 to be pressurized if it is to be used as a package in which to sell tennis balls. Pop-top 34 is removed when it is desired to remove tennis balls 1 from container 30. Container 30 has an upper circumferential groove 35 and a lower circumferential groove 36. Grooves 35 and 36 are formed in container 30 by reducing the diameter of the side wall of container 30 at two locations. Grooves 35 and 36 act as connecting means, as will be described below.

Figure 4:
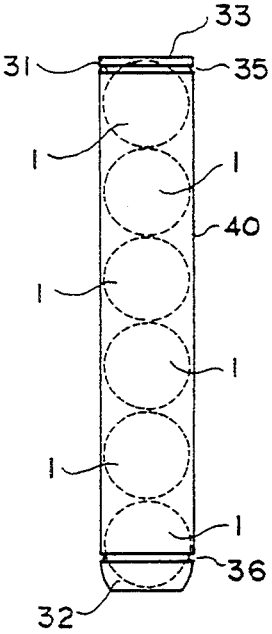
FIG. 4 is an elevational view of a second embodiment of the container of the present invention.

Container 40, shown in FIG. 4, is long enough to hold six standard tennis balls. Otherwise, it is essentially identical to container 30. The container of the present invention could be made having any practical length; it could be made long enough to hold, for example, twelve tennis balls.

The container of the present invention could also be made with two open ends. In such a case, one could put a cap 10 on each end; also, one could include a divider intermediate (and preferably halfway between) the two open ends so that not all of the weight of the balls 1 would be bearing down on the cap 10, but half could bear down instead on the divider. In this manner, it is less likely that the weight of the balls 1 would cause cap 10 to come off of the container.

Figure 5:
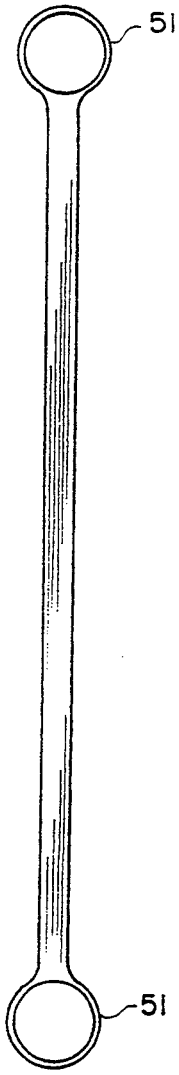
FIG. 5 is a plan view of a shoulder strap in accordance with the preferred embodiment of the present invention.
Figure 6A:
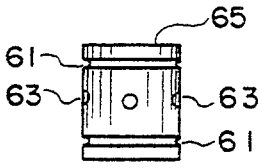
FIG. 6*a* is an elevational view of a connecting member in accordance with a first embodiment of the present invention.
Figure 6B:
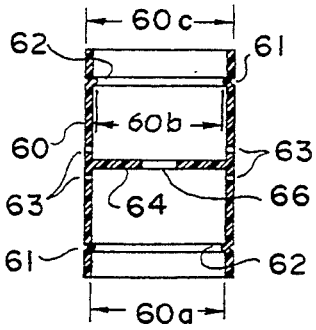
FIG. 6*b* is a sectional view of the preferred embodiment of the connecting member of the present invention.

Shoulder strap 50, shown in FIG. 5, is the preferred embodiment of the shoulder strap of the present invention. Shoulder strap 50 is an elongated flexible plastic member having a flexible ring 51 adjacent each end. Rings 51 have an inner diameter approximately equal to the reduced diameter portions of container 30 forming grooves 35 and 36. Rings 51 act as connecting means to connect strap 50 to the containers of the present invention, as will be described further.

Connecting sleeve 60 (FIG. **6*b*) is the preferred embodiment of the connecting member of the present invention. Sleeve 60 has a first portion comprising a first, inner diameter 60*a* approximately equal to the outer diameter of container 30 and circumferential inward projections 62 having a second, reduced inner diameter 60*b* approximately equal to the reduced diameter portion forming grooves 35 and 36 of container 30. Sleeve 60 has two grooves 61 (formed by two portions of a reduced outer diameter 60*c*). The wall of sleeve 60 is quite thin, such that diameters 60*b* and 60*c* are almost equal. Holes 63 may be provided in sleeve 60 to allow air to exit sleeve 60 when sleeve 60 is used to connect two tennis ball containers. Sleeve 60 also has an inwardly-projecting stop 64 having a hole 66 therein. Stop 64 prevents the tennis ball containers 30 from passing the center of sleeve 60**.

Sleeve 65 (FIG. **6*a*) is similar to sleeve 60, but has fewer holes 63 and has no stop 64**.

Figure 7:
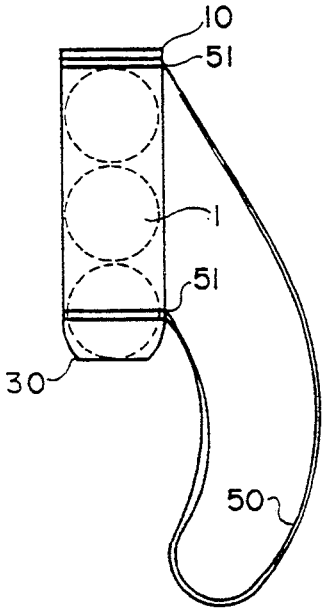
FIG. 7 is a side view of the container of the preferred embodiment of the present invention removably connected to the retrieval cap of the preferred embodiment of the present invention and to the shoulder strap of the preferred embodiment of the present invention.
Figure 9:
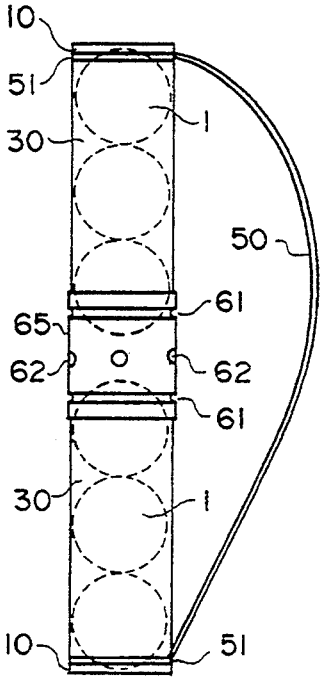
FIG. 9 is a view similar to FIGS. 7 and 8 showing two containers of the preferred embodiment of the present invention connected with a connecting member of the preferred embodiment of the present invention.
Figure 8:
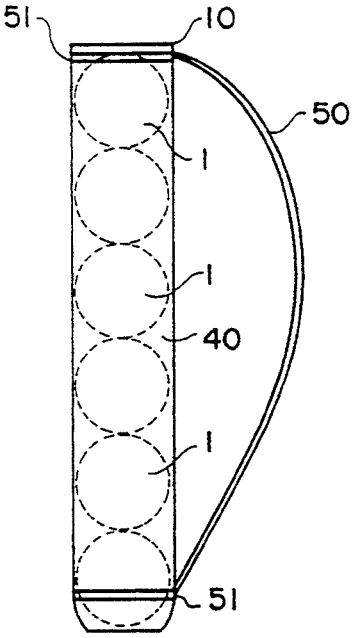
FIG. 8 is a view similar to FIG. 7, but with the second embodiment of the container of the present invention replacing the container shown in FIG. 7.

FIG. 7 shows a container 30 of the preferred embodiment of the present invention having strap 50 and cap 10 removably connected thereto. A first ring 51 of strap 50 is disposed in groove 35 (FIG. 3) adjacent the first end of container 30 and a second ring 51 of strap 50 is disposed in groove 36 adjacent the second end of container 30. Cap 10 is removably attached to metal rim 33 of container 30. A similar setup is shown in FIG. 8, but with a container 40 in place of container 30. In FIG. 9, two containers 30 are shown connected adjacent their second ends with connecting sleeve 65. A first circumferential inner projection 62 of sleeve 65 is removably engaged with groove 36 of one of the containers 30 and a second projection 62 is removably engaged with groove 36 of the other container 30. Thus, the projections 62 act as engaging means for engaging grooves 36 of containers 30, which grooves 36 act as connecting means, for enabling one container 30 to be connected to another. Strap 50 is attached adjacent the first end of each container 30 with rings 51 which are disposed in grooves 35 of containers 30. Containers 30 each have a cap 10 disposed adjacent their first ends on rims 33. As can be seen in FIG. 9, containers 30 are removably serially connected in a longitudinally aligned fashion. In other words, they are longitudinally aligned end-to-end.

Figure 10:
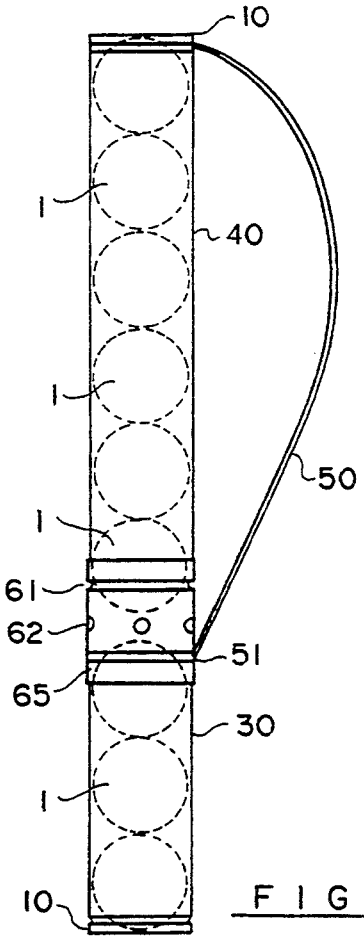
FIG. 10 is similar to FIG. 9, but with one of the containers being replaced with the container shown in FIG. 4.

FIG. 10 shows a setup similar to FIG. 9, but with a container 40 replacing one of the containers 30. The setup shown in FIG. 10 otherwise differs from that shown in FIG. 9 in that one of the rings 51 of strap 50 is connected to one of grooves 61 of connecting sleeve 65. Thus, grooves 61 act as strap-receiving means for receiving the connecting means (ring 51) of strap 50. The setup shown in FIG. 11 differs from that shown in FIG. 10 in that the container 30 is replaced with another container 40.

Sleeves 60 and 65 are preferably made of flexible material, and may comprise the same material used to make cap 10 and strap 50. When diameter **60*a* is approximately equal to or slightly smaller than the outer diameter of the container 30, circumferential inward projections 62 are not necessary, and may be omitted, as the frictional engagement of sleeve 60 or 65 with the first diameter portions of two containers 30 is sufficient to hold the containers together. In such a case, sleeve 60 or 65 could also be used to connect two standard tennis ball containers 2, and the upper and lower halves of sleeve 60 or 65 would act as engaging means for engaging the second ends of standard tennis ball containers 2. When a strap 50 and caps 10 are added to the setup, it would look very similar to FIG. 9**.

Figure 12:
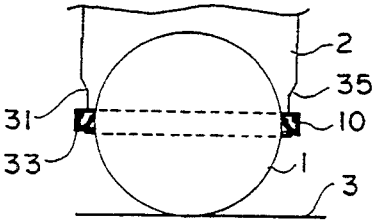
FIG. 12 shows a ball entering the container through the cap, of the preferred embodiment of the present invention, whose inner rim expands to allow the ball to pass therethrough.
Figure 13:
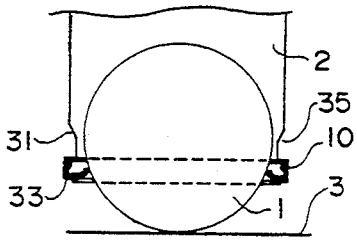
FIG. 13 is a view similar to FIG. 12, showing the inner rim of the cap after it has regained its original shape.

FIGS. 12 and 13 show cap 10 removably fitted on rim 33 of the standard tennis ball container 2 (only a portion of which is shown in FIGS. 12 and 13), such as that currently used to package three Wilson or Penn tennis balls for sale in the United States and made by Continental Can Company of Olive Branch, Miss. Container 2 has a groove 35 and is made of clear plastic. Container 2 differs from container 30 of the preferred embodiment of the present invention in that container 2 has no groove 36.

Figure 11:
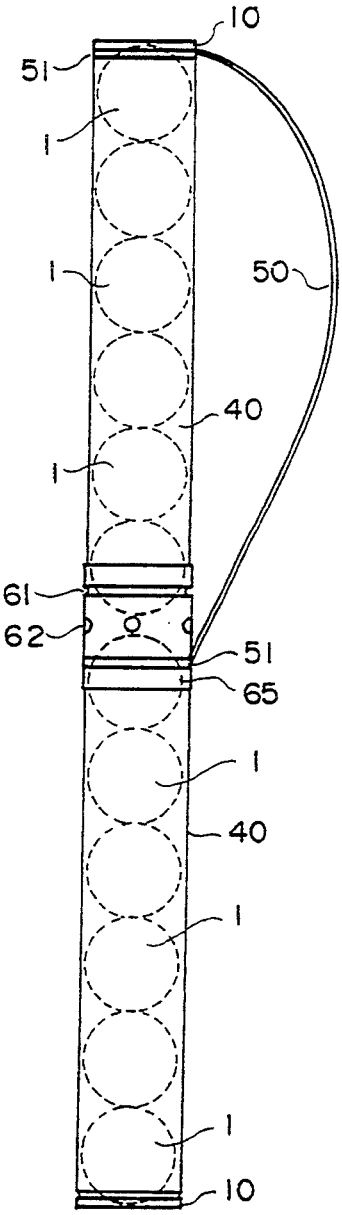
FIG. 11 is a view similar to FIG. 9, but with both containers being replaced by containers as shown in FIG. 4.

In operation, the first, open end of container 2 is pressed down over ball 1 on tennis court 3, with opening 11 in cap 10 aligned with tennis ball 1. As ball 1 passes through cap 10, inner rim 12 expands (FIG. 12). After the equator of ball 1 passes through cap 10, inner rim 12 of cap 10 regains its original shape, trapping ball 1 in container 2. When it is desired to remove ball 1 from container 2, cap 10 is removed from the first end of container 2 and container 2 is tilted such that ball 1 rolls out. The setups shown in FIGS. 7–11 operate in the same manner. The setup shown in FIGS. 7–11 are more advantageous than that shown in FIGS. 12 and 13 because they have straps 50 to make them easier to carry, and the setups shown in FIGS. 8–11 are more advantageous than that shown in FIGS. 12 and 13 because they are longer, requiring less stooping by a player in order to retrieve balls 1. The setups shown in FIGS. 9–11 are also advantageous in that they may be broken down into components of smaller length to make storage easier.

Figure 14:
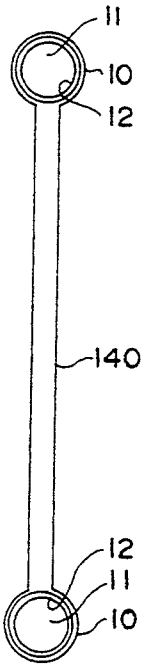
FIG. 14 shows an alternative embodiment of the shoulder strap of the present invention.

An alternative embodiment of the strap of the present invention, strap 140, is shown in FIG. 14. Strap 140 has a cap 10 integrally formed therewith adjacent each end, in place of rings 51 of strap 50. Alternatively, caps 10 could be glued or otherwise attached adjacent each end of strap 140. Strap 140 could be used, for example, in the setup shown in FIG. 9 to replace strap 50 and individual caps 10. Also, one could make a strap having a cap 10 integrally formed therewith on one end and a ring 50 adjacent the other end.

Figure 15A:
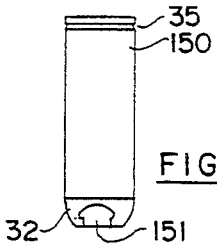
FIGS. 15*a*, 16*a*, 17*a*, and 18*a* show alternative embodiments of the containers of the present invention.
Figure 15B:
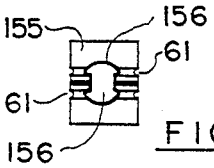
FIGS. 15*b*, 16*b*, 17*b*, and 18*b* show sectional views of alternative embodiments of the connecting members of the present invention, usable with the containers shown in FIGS. 15*a*, 16*a*, 17*a*, and 18*a*, respectively.

Container 150, shown in FIG. 15*a*, has a socket 151 adjacent its second, closed end to allow it to be connected to another like container with connecting sleeve 155, which has projections 156 for releasably engaging socket 151.

Figure 16A:
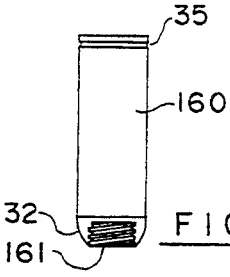
Figure 16B:
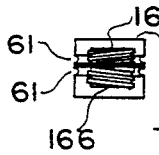
Figure 17A:
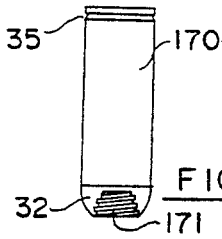
Figure 17B:
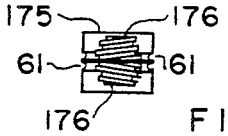

Containers 160 and 170, shown in FIGS. 16*a* and 17*a*, respectively, have threaded sockets 161 and 171, respectively. Threaded projections 166 and 176 of connecting sleeves 165 and 175, respectively, threadably engage with sockets 161 and 171, respectively, to interconnect sleeves 165 and 175 with containers 160 and 170, respectively.

Figure 18A:
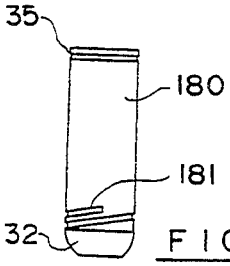
Figure 18B:
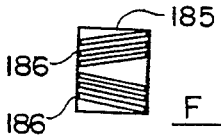

Container 180 (FIG. 18*a*) has threaded grooves 181 with which threads 186 of sleeve 185 (FIG. 18*b*) mesh to releasably interconnect container 180 and sleeve 185.

Figure 19A:
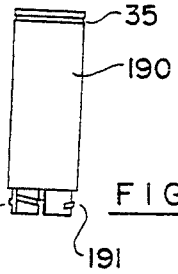
FIG. 19*a* is another alternative embodiment of the container of the present invention.
Figure 19B:
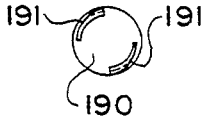
FIG. 19*b* is a bottom view of the container of FIG. 19*a*.

Container 190 (FIGS. 19*a* and 19*b*) has two threaded projections 191 adjacent its second end. The projections 191 of container 190 interlock with like projections of a like container by placing the second ends of the container together with the containers axially aligned and their projections 141 offset, then twisting the container on the bottom clockwise to releasably lock the containers together.

Caps 200, 210, 220, 230, 240, 250, 260, 270, 280, and 290 (shown in FIGS. 20*a* and 20*b*, 21*a* and 21*b*, 22*a* and 22*b*, 23*a* and 23*b*, 24*a* and 24*b*, 25*a* and 25*b*, 26*a* and 26*b*, 27*a* and 27*b*, 28*a* and 28*b*, and 29*a* and 29*b*, respectively) are similar to cap 10, but comprise different means for effectively reducing the diameters of their openings to less than the diameter of a tennis ball 1.

Cap 200 has an inwardly projecting rim 202 forming a sunflower-shaped opening 201. Rim 212 of cap 210 forms a hexagonal opening 211. Cap 220 has a crescent-shaped inward projection 222 forming an opening 211. Cap 230 has a crescent-moon shaped projection forming a Gibbous-moon shaped opening 31. Cap 240 has a number of inwardly projecting tabs 242 forming an octagonal opening 241. Cap 250 has a single inwardly projecting tab 252 effectively reducing the diameter of opening 251. Cap 260 has a plurality of overlapping inwardly projecting tabs 262 forming a hexagonal opening 261. Cap 270 has a strip 272 projecting across opening 271. Cap 280 has a spring 282 projecting across opening 281. Cap 290 has a plastic sleeve bearing 292 projecting across opening 291.

Figures 20A, 20B, 21A, 21B, 22A, 22B, 23A, 23B, 24A, 24B, 25A, 25B, 26A, 26B, 27A, 27B, 28A, 28B, 29A, 29B, 30A, 30B, 30C, 31A, 31B, 31C, 32A, 32B, 32C, 33A, 33B, 33C, 34A, 34B, 35A, 35B:
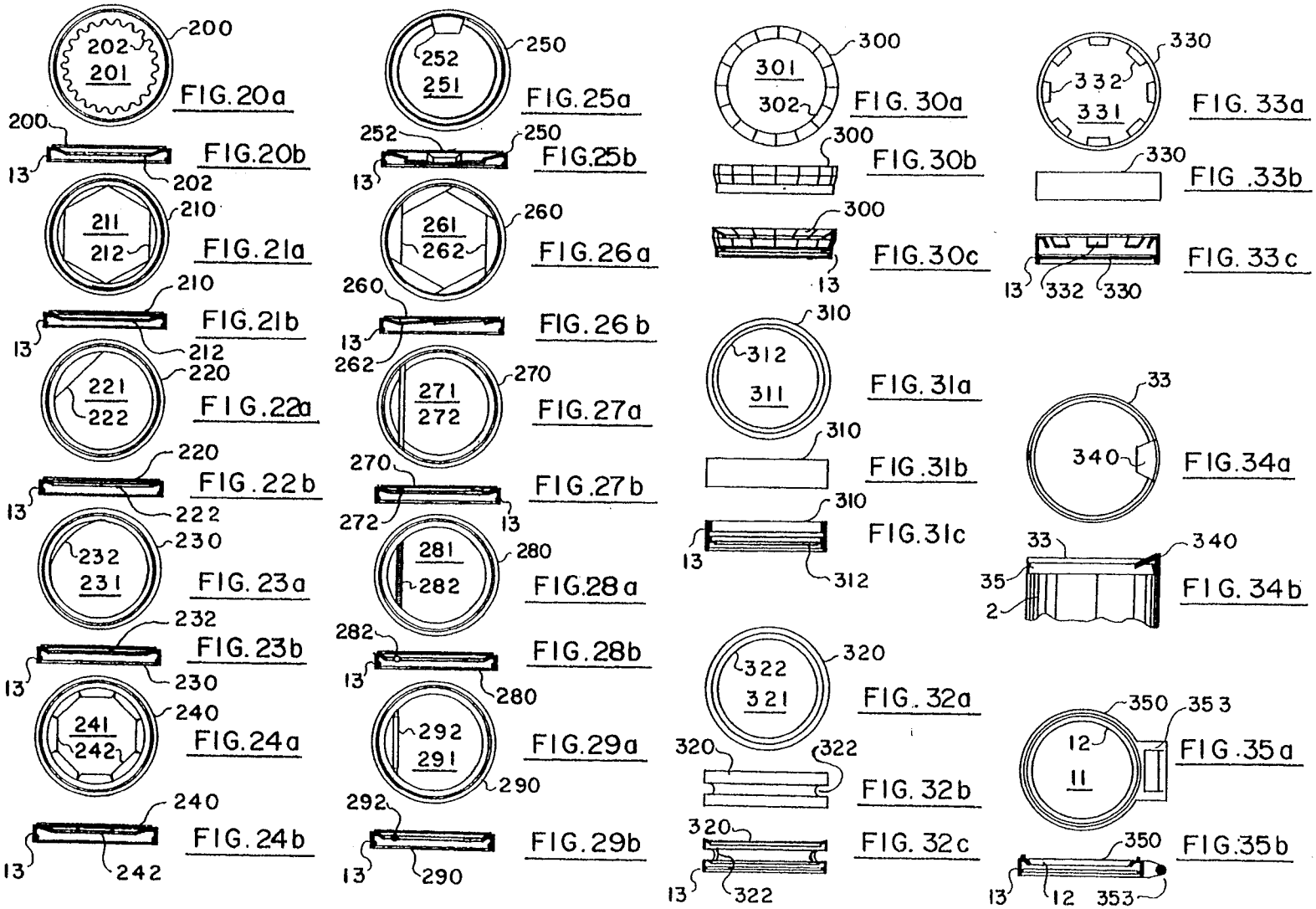

Cap 30 (FIGS. 30*a*, 30*b*, and 30*c*) has a plurality of resilient fingers 302 and an opening 301. Cap 310 (FIGS. 31*a*, 31*b*, and 31*c*) has a flexible inner rim 312, an opening 311, and an upwardly projecting collar 313. Collar 313 has an inner diameter greater than that of a tennis ball, and aids in aligning a container on which cap 310 is disposed with a tennis ball. Cap 320 (FIGS. 32*a*, 32*b*, and 32*c*) has a circumferential inward projection 322 and an opening 321. Cap 330 (FIGS. 33*a*, 33*b*, and 33*c*) has a number of inwardly projecting tabs 332 and an opening 331. FIGS. 34*a* and 34*b* show a removable clip 340 mounted on the metal rim 33 of a standard tennis ball container 2. Clip 340 effectively reduces the diameter of the opening of container 2 to less than that of a tennis ball, and acts as a cap in the sense that it is removable and prevents balls from rolling out of container 2. It can be made, for example, of metal or plastic. Cap 350 (FIGS. 35*a* and 35*b*) is similar to cap 10, but additionally comprises a strap connector 353.

All of the caps may advantageously be made of the same material as cap 10.

Figure 36:
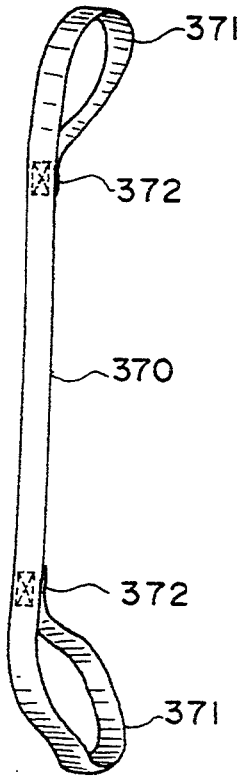
FIG. 36 shows an alternative embodiment of the shoulder strap of the present invention.

Shoulder strap 370, shown in FIG. 36, is an alternative embodiment of the shoulder strap of the present invention. Shoulder strap 370 is an elongated flexible elastic member having a flexible ring 371 adjacent each end. Rings 371 have an inner diameter approximately equal to, but slightly smaller than, the outer diameter of tennis ball container 30. Rings 371 act as connecting means to connect strap 370 to the containers of the present invention. Shoulder strap 370 is formed by taking a piece of elastic fabric, rolling the ends, and sewing the ends at stitch line 372 to for rings 371. Strap 370 is attached to a tennis ball container by stretching rings 371 enough so that they slip over the ends of the tennis ball container. The elastic in rings 371 causes rings 371 to frictionally engage the tennis ball container.

Figure 37:
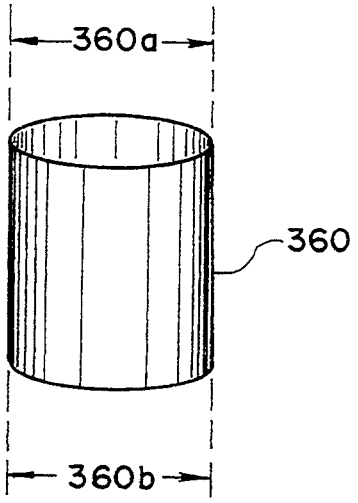
FIG. 37 is a perspective view of an alternative embodiment of the connecting member of the present invention.

Connecting sleeve 360 (FIG. 37) is another embodiment of the connecting member of the present invention. Sleeve 360 has an inner diameter 360*a* approximately equal to the outer diameter of container 30 and an outer diameter 360*c*. Sleeve 360 can advantageously be made of polybutylene or polycarbonate plastic. Connecting sleeve 360, as can be seen in FIG. 37, is simply a cylinder. Two tennis ball containers are connected using connecting sleeve 360 by inserting the bottom end of each tennis ball container in connecting sleeve 360. The inner diameter 360*a* is chosen so that friction keeps tennis ball containers from easily coming out of sleeve 360 once the tennis ball containers are inserted therein. Inner diameter 360*a* is preferably 231/32 inches and outer diameter 360*c* can be, for example, 33/32 inches. Sleeve 360 can be, for example, 4 inches high.

The inner surface of connecting sleeve 360 can be considered engaging means, as it engages the exterior surface of two tennis ball containers to be connected when the containers are inserted therein.

Although the apparatus herein has been described in conjunction with tennis balls, the embodiments shown herein could be modified to pick up baseballs, golf balls, or other types of sports balls. When used to pick up tennis balls, it is preferred that cap 10 and the other caps shown in the drawings be sized to fit on a container having a diameter between 2½ and 3½ inches, and most preferably approximately 3 inches.

The foregoing disclosure and description of the invention are illustrative and explanatory thereof, and various changes in the size, shape and materials, as well as in the details of the illustrated construction may be made without departing from the spirit of the invention.

What is claimed as invention is:

1. A tennis ball apparatus comprising:

a connecting member for removably serially connecting first and second tennis ball containers in a longitudinally aligned fashion, each container having a first, open end and a second, closed end, and being sized to contain at least three tennis balls, the connecting member comprising:

first and second ends; and first and second engaging means for engaging the tennis ball containers.

2. The apparatus of claim 1, wherein:

the tennis ball containers each comprise a first portion having a first outer diameter; and the connecting member comprises a sleeve having an inner surface, an outer surface, and a first inner diameter substantially the same size as the first outer diameter of the tennis ball container.

3. The apparatus of claim 1, further comprising:

a cap, for converting the first tennis ball container into a ball pickup device, comprising:

(a) means for removably fitting the cap on the first, open end of the first tennis ball container; and (b) retrieving means for allowing balls to enter the first tennis ball container through the cap when the cap is removably fitted on the first end of the first tennis ball container and for preventing balls from exiting the first tennis ball container through the cap when the cap is removably fitted on the first end of the first tennis ball container.

4. The apparatus of claim 3, wherein:

the balls are tennis balls.

5. The apparatus of claim 4, wherein:

the first tennis ball container has a diameter slightly greater than that of a tennis ball.

6. The apparatus of claim 5, wherein:

the diameter of the first tennis ball container is not more than thirty percent greater than the diameter of a tennis ball.

7. The apparatus of claim 4, wherein:

the first end of the first tennis ball container has a diameter of between 2½ inches and 3½ inches.

8. The apparatus of claim 7, wherein:

the first end of the first tennis ball container has a diameter of approximately 3 inches.

9. The apparatus claim 3, wherein:

the cap has an opening; and the retrieving means comprises diameter-limiting means for limiting the diameter of the opening to less than the diameter of the tennis ball.

10. The apparatus of claim 9, wherein:

the cap is unitary.

11. The apparatus of claim 3, further comprising:

a tennis ball container having a diameter not greater than thirty percent larger than the diameter of a tennis ball and a length not less than three times the diameter of a tennis ball.

12. The apparatus of claim 11, wherein:

the first tennis ball container has a length not less than six times the diameter of a tennis ball.

13. The apparatus of claim 3, wherein:

the first tennis ball container has an outside diameter of between 2½ and 3½ inches.

14. The apparatus of claim 13, wherein:

the first tennis ball container has an outside diameter of approximately 3 inches.

15. The apparatus of claim 3, further comprising:

the first and second tennis ball containers, wherein the connecting member removably serially connects the first and second tennis ball containers in a longitudinally aligned fashion, and the cap is removably fitted on the first, open end of the first tennis ball container.

16. The apparatus of claim 1, further comprising:

the first and second tennis ball containers, wherein the connecting member removably serially connects the first and second tennis ball containers in a longitudinally aligned fashion.

17. A tennis ball apparatus comprising:

(a) a first tennis ball container having a first, open end and a second, closed end;

(b) a second tennis ball container having a first, open end and a second, closed end;

(c) a connecting member for removably serially connecting the first and second tennis ball containers in a longitudinally aligned fashion, the connecting member including:

(i) first and second ends; and (ii) engaging means for engaging the tennis ball containers;

(d) a strap having connecting means for removably attaching the strap to at least one of the tennis ball containers;

(e) a cap, for converting the first tennis ball container into a ball pickup device, comprising:

(i) means for removably fitting the cap on the first, open end of the first tennis ball container; and (ii) retrieving means for allowing balls to enter the first tennis ball container through the cap when the cap is removably fitted on the first end of the first tennis ball container and for preventing balls from exiting the first tennis ball container through the cap when the cap is removably fitted on the first end of the first tennis ball container.

18. A tennis ball apparatus comprising:

a first cap connected to a strap, the strap having a length at least on the order of the diameter of three standard tennis balls, the cap comprising:

(a) means for removably fitting the cap on a first, open end of a tennis ball container; and (b) retrieving means for allowing balls to enter the container through the cap when the cap is removably fitted on the first end of the container and for preventing balls from exiting the container through the cap when the cap is removably fitted on the first end of the container; and a connecting member for removably serially connecting first and second tennis ball containers in a longitudinally aligned fashion, each container having a first, open end and a second, closed end, the connecting member comprising:

first and second ends; and first and second engaging means for engaging the tennis ball containers, wherein the cap is removably fitted on the first, open end of the first tennis ball container.

19. A tennis ball apparatus comprising:

a first cap connected to a strap, the strap having a length at least on the order of the diameter of three standard tennis balls, the cap comprising:

(a) means for removably fitting the cap on a first, open end of a tennis ball container; and (b) retrieving, means for allowing balls to enter the container through the cap when the cap is removably fitted on the first end of the container and for preventing balls from exiting the container through the cap, when the cap is removably fitted on the first end of the container;

a second cap connected to the first cap with the strap, the second cap comprising:

means for removably fitting the second cap on a first, open end of a tennis ball container; and retrieving means for allowing balls to enter the container through the second cap when the second cap is removably fitted on the first end of the container and for preventing balls from exiting the container through the second cap when the second cap is removably fitted on the first end of the container.

* * * * *